US011129507B2

(12) United States Patent
Martinez Manjarrez

(10) Patent No.: US 11,129,507 B2
(45) Date of Patent: Sep. 28, 2021

(54) ROLLER COVER TOILET SYSTEM AND METHOD

(71) Applicant: Jose Alberto Martinez Manjarrez, Las Vegas, NV (US)

(72) Inventor: Jose Alberto Martinez Manjarrez, Las Vegas, NV (US)

( * ) Notice: Subject to any disclaimer, the term of this patent is extended or adjusted under 35 U.S.C. 154(b) by 151 days.

(21) Appl. No.: 16/543,486

(22) Filed: Aug. 16, 2019

(65) Prior Publication Data

US 2020/0077849 A1 Mar. 12, 2020

Related U.S. Application Data

(60) Provisional application No. 62/730,459, filed on Sep. 12, 2018.

(51) Int. Cl.

| | |
|---|---|
| ***A47K 13/22*** | (2006.01) |
| ***A47K 13/20*** | (2006.01) |
| ***A47K 10/34*** | (2006.01) |
| ***A47K 10/36*** | (2006.01) |

(52) U.S. Cl.

CPC ..... *A47K 13/22* (2013.01); *A47K 10/34* (2013.01); *A47K 10/36* (2013.01); *A47K 13/20* (2013.01)

(58) Field of Classification Search

CPC ..... A47K 13/22; A47K 13/20; A47K 10/34; A47K 10/36

USPC ..... 4/243.3

See application file for complete search history.

(56) References Cited

U.S. PATENT DOCUMENTS

| | | | | |
|---|---|---|---|---|
| 3,751,738 | A * | 8/1973 | Vairo | A47K 13/22 4/243.3 |
| 4,627,117 | A | 12/1986 | Morishita | |
| 4,926,505 | A | 5/1990 | Higuchi et al. | |
| 5,551,096 | A | 9/1996 | Gardner | |
| 7,707,661 | B2 | 5/2010 | Issachar | |
| 8,621,675 | B2 | 1/2014 | Aspiro | |
| 10,433,684 | B1 * | 10/2019 | Cen | A47K 13/22 |
| 2004/0251292 | A1 * | 12/2004 | Grebonval | A47K 10/3818 225/39 |
| 2007/0220664 | A1 * | 9/2007 | Getahun | A47K 13/22 4/244.1 |
| 2010/0293704 | A1 * | 11/2010 | Ehlenbach | A47K 13/22 4/245.4 |
| 2014/0216627 | A1 * | 8/2014 | Stumpe | B29C 63/024 156/60 |

* cited by examiner

*Primary Examiner* — Jennifer C Chiang

(74) *Attorney, Agent, or Firm* — Runyan Law; Charles Runyan

(57) ABSTRACT

The roller cover toilet system provides users with a portable roll-on cover for public toilets designed to keep the seat surface sanitary while sitting. The device features a dustpan-like carrying system designed to house the roll of covers. It allows users to simply roller the cover over the seat and apply it via a light adhesive, ensuring the cover remains stable as the user sits. The device prevents germs and bacteria from being contracted, ensuring the user stays clean even while using a public toilet. The device eliminates the need to use flimsy paper covers commonly found in public restrooms.

20 Claims, 5 Drawing Sheets

ROLLER COVER TOILET SYSTEM AND METHOD

CROSS-REFERENCE TO RELATED APPLICATION(S)

The present application is related to and claims priority to U.S. Provisional Patent Application No. 62/730,459 filed 12 Sep. 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of protecting covers for closet seats of paper or plastic webs rolled-up and dispensers therefor of existing art and more specifically relates to roller cover toilet systems.

RELATED ART

Many modern buildings have indoor plumbing. Public buildings may have public toilets for use. Public toilets can be extremely unsanitary and odorous. People may need to apply seat covers before sitting on the toilet. Standard seat covers are made of paper and may be difficult to apply. Commonly, the seat covers move as the user sits and coverage may not be optimal. A suitable solution is desired.

U.S. Pat. No. 5,551,096 to G. Byron Gardner relates to a disposable toilet seat cover apparatus which includes a continuous, flexible, biodegradable base sheet which has two side edges, a leading edge, a top side, and a bottom side. The base sheet includes a plurality of sets of perforations positioned at predetermined intervals along the base sheet, wherein each set of the perforations extends across the base sheet from one side edge to the other side edge. A coating of tacky adhesive is placed on the bottom side of the base sheet and is coextensive with the bottom side of the base sheet. The base sheet with the tacky adhesive on the bottom side of the base sheet is wound into a roll whereby portions of the tacky adhesive contact portions of the top side of the base sheet. As a result, the roll is maintained as a compact roll. The roll is unrolled by pulling the leading edge of the base sheet away from the roll. The coating of tacky adhesive is water repellent. The base sheet is made from a relatively non-porous paper. By using the disposable toilet seat cover apparatus, a method of covering a horse-shoe shaped toilet seat is provided. In addition, a method is provided for covering an oval shaped toilet seat.

SUMMARY OF THE INVENTION

In view of the foregoing disadvantages inherent in the known protecting covers for closet seats of paper or plastic webs rolled-up and dispenser art, the present disclosure provides a novel roller cover toilet system. The general purpose of the present disclosure, which will be described subsequently in greater detail, is to provide an effective and efficient roller cover toilet system.

The present invention provides users with a portable roll-on cover for public toilets (roller cover toilet system) designed to keep the seat surface sanitarily covered for sitting. The device features a dustpan-like carrying system designed to house the roll of covers. It allows users to simply roller the cover over the seat and apply the cover to stick to the toilet seat via a light adhesive, ensuring the cover remains stable as the user sits. The device effectively prevents germs and bacteria from being contracted, ensuring the user stays clean even while using a public toilet. The present invention eliminates the need to use flimsy paper covers commonly found in public restrooms.

A roller cover toilet system is disclosed herein, the system comprising: a roller-dispenser assembly including a roller-dispenser apparatus with a body defined by a roller receiver with a cutting edge; and a handle; and a roller for sequentially roll-applying an interchangeable roll of continuous, flexible cover-sheet; the cover-sheet having two side edges, a top-side and a bottom-side, the cover-sheet having a leading edge for delivery, the bottom-side having an attachment means for removably attaching the cover-sheet, once dispensed and cut via the roller-dispenser apparatus, to a toilet seat upper surface to promote a sanitary seating surface for a toilet-user.

According to another embodiment, a method of use for the roller cover toilet system is also disclosed, the method comprising the steps of providing the roller cover toilet system; loading a roll of flexible cover-sheet in a roller receiver; and roll-applying the cover-sheet to a toilet seat upper surface to promote a sanitary seating surface for a toilet-user; wherein the step of roll-applying allows an adhesive to promote coupling between the cover-sheet and the toilet seat upper surface.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a roller cover toilet system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to protecting covers for closet seats of paper or plastic webs rolled-up and more particularly to a roller cover toilet system as used to improve the sanitary use of toilets.

Generally, the present invention is a roll-on system of toilet seat covers. The system is preferably comprised of a plastic holder unit, shaped similarly to a dustpan, and a set of seat covers in a roll configuration. The seat covers can feature an adhesive to stick securely to the toilet seat. Users can simply roll on the seat covers and allow the adhesive to secure to the seat. The seat cover ensures a sanitary seat for the user to go to the bathroom. The cover can be removed and flushed when done.

Referring now more specifically to the drawings by numerals of reference, there is shown in FIGS. 1-5, various views of a roller cover toilet system 100.

Figure 1:
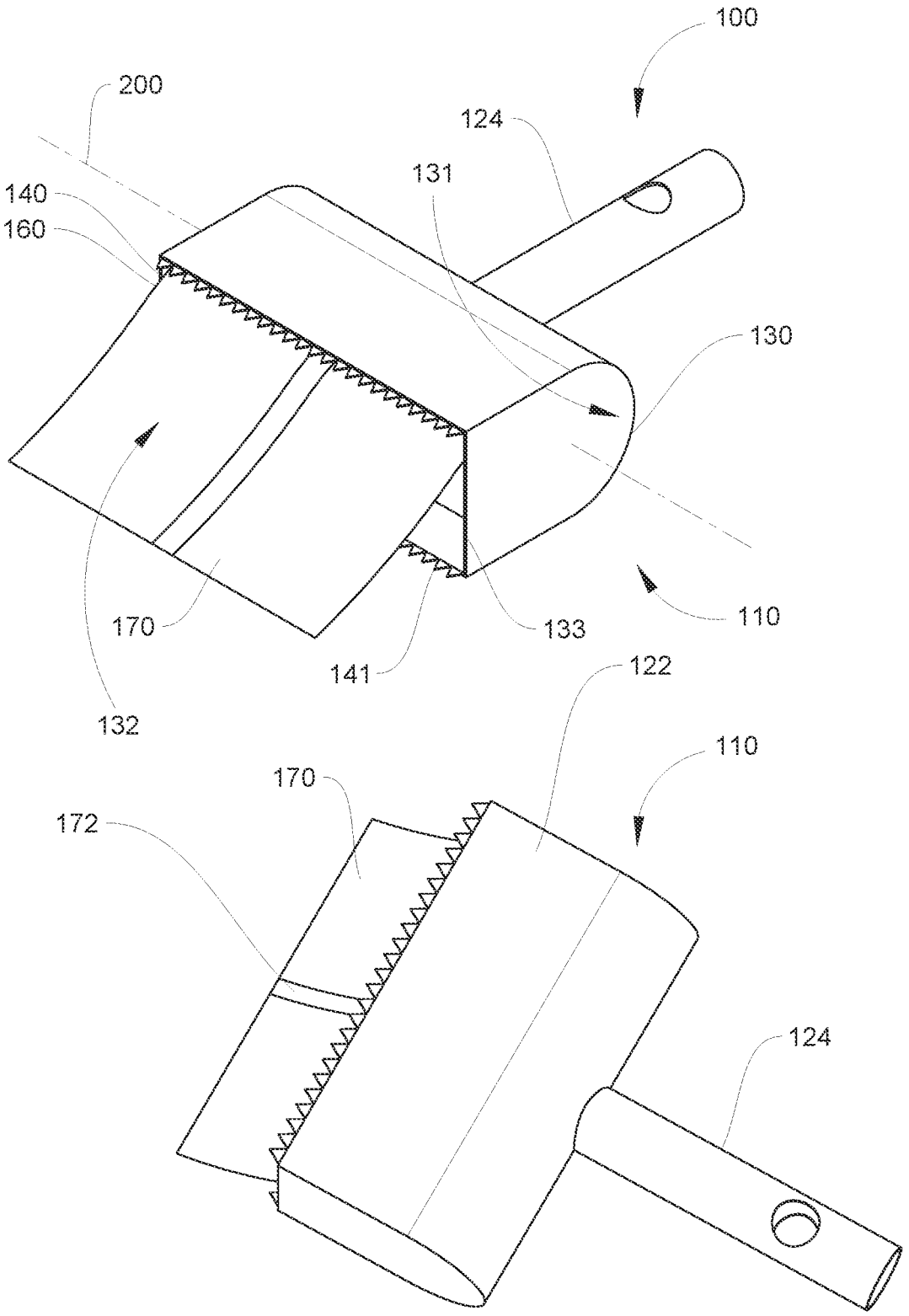
FIG. 1 is a perspective view of the roller cover toilet system ready for an 'in-use' condition (vertically mounted), according to an embodiment of the disclosure.
Figure 3:
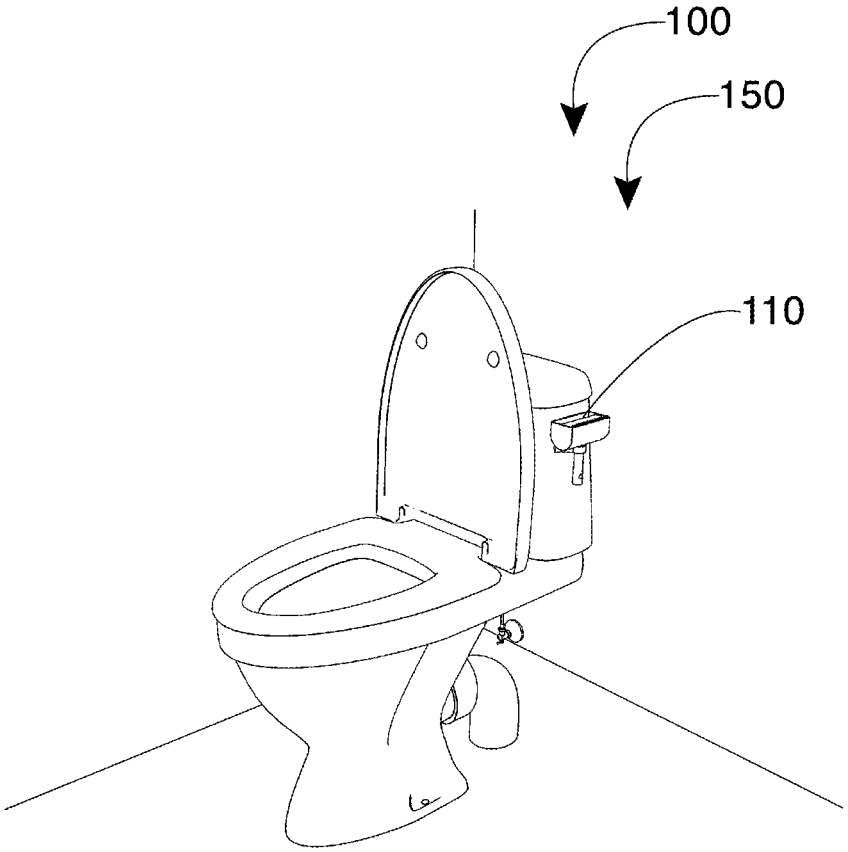
FIG. 3 is another perspective view of the roller-dispenser apparatus of the roller cover toilet system of FIG. 1, according to an embodiment of the present disclosure.

FIG. 1 shows a roller cover toilet system 100 during an 'in-use' condition 150, according to an embodiment of the present disclosure. Here, the roller cover toilet system 100 may be beneficial for use by a user to promote sanitary use of toilets. As illustrated, the roller cover toilet system 100 may include a roller-dispenser assembly 110 including a roller-dispenser apparatus 120 with a body 122 defined by a roller receiver 130 characterized by cylindrical profile 131 with at least one cutting edge 140; and a handle 124 (the handle 124 is preferably substantially perpendicular to the roller receiver 130 for ease of use during roll-applying for angled downward pressure to couple cover-sheet 170 as needed); and a roller 160 for sequentially roll-applying an interchangeable roll of continuous, flexible cover-sheet 170, the cover-sheet 170 having two side edges, a top-side and a bottom-side. Roller 160 may rotate upon roller-axis 200 within roller receiver 130 as shown. Proximate to roller 160 may be opening 132, being characterized by rectangular edge 133. First-serrated-edge 140 and second-serrated-edge 141 are shown. The cover-sheet 170 has a leading edge (first through for dispensing) for delivery, the bottom-side having an attachment means for removably attaching the cover-sheet 170, once dispensed and cut via the roller-dispenser apparatus 120, to a toilet seat upper surface to promote a sanitary seating surface for a toilet-user. The cover-sheet 170 may or may not be offered on host rolls. FIG. 3 shows the cover-sheet 170 of the present system 100 as being dispensed by the roller-dispenser apparatus 120.

Figure 2:
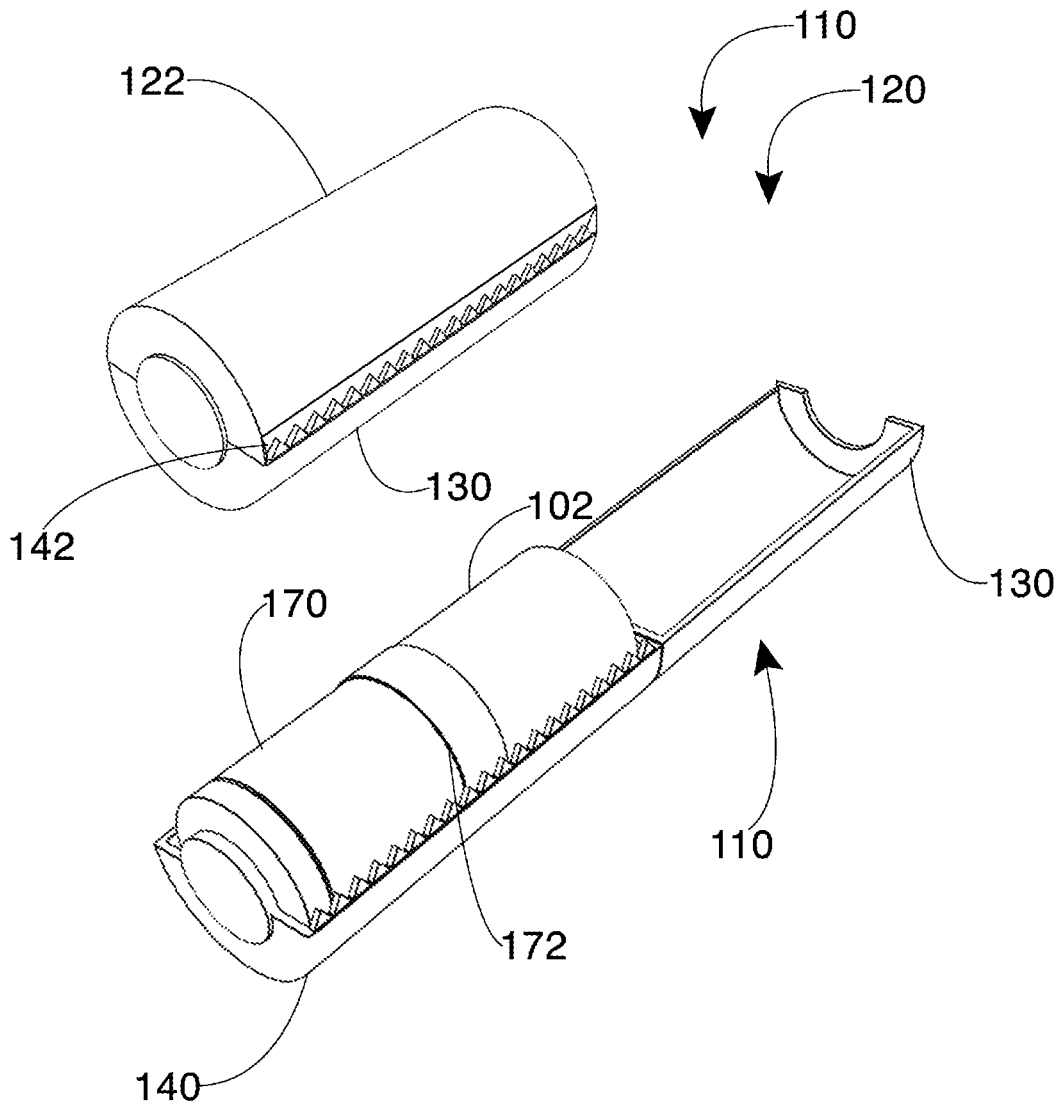
FIG. 2 is a perspective view of the roller-dispenser apparatus of the roller cover toilet system of FIG. 1, according to an embodiment of the present disclosure.

FIG. 2 is a perspective view of the roller-dispenser apparatus 120 of the roller cover toilet system 100 of FIG. 1, according to an embodiment of the present disclosure with the roll 102 of cover-sheet 170 as fit in the inner volume (the roller receiver 130 may hinge to open and close). FIG. 3 is another perspective view of the roller-dispenser apparatus 120 of the roller cover toilet system 100 of FIG. 1, according to an embodiment of the present disclosure.

Figure 4:
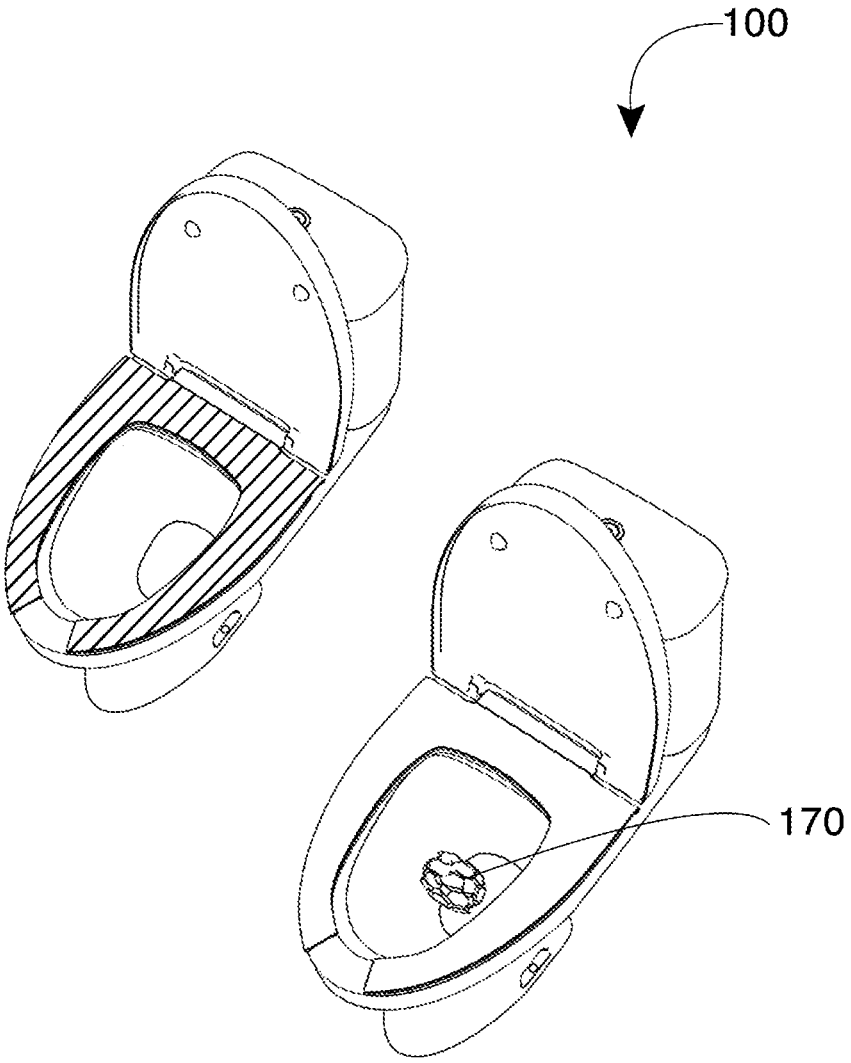
FIG. 4 is a perspective view of the roller cover toilet system of FIG. 1, as flushable, according to an embodiment of the present disclosure.

The cutting edge 140 comprises at least one serrated-edge 142 (other cutting means may be used as known in the art) and the cover-sheet 170 preferably comprises paper and in alternate embodiments comprises non-paper. The cover-sheet 170 is bio-degradable and does not negatively impact sewer systems. The attachment means comprises adhesive 172; wherein the adhesive 172 preferably is a linear strip (as shown) to maintain continuous coupling during use (FIG. 4). The cover-sheet 170 with the adhesive 172 is flushable (FIG. 4). The adhesive 172 is deformable and once crushed slightly exposes 'sticky' coupling means. The sticking means doesn't 'over-stick' such that it is easy to remove but maintains relative positioning during use.

The body 122 of the present invention preferably comprises plastic for longevity in use however other suitable equivalent materials may be used. The roller receiver 130 preferably comprises a cylindrical (arcuate) profile to form an accessible inner-volume (which may be opened and closed via sliding or the like). This feature allows for rolls 102 to be inserted, or removed and replaced. The roller-dispenser assembly 110 of the roller cover toilet system 100 is removably mountable to vertical surfaces such as a toilet tank or on horizontal surfaces. In this way the present invention is not 'in the way' during non-use periods and yet is easy to access during in-use conditions.

The cutting edge 140 in certain embodiments comprises a first-serrated-edge and a second-serrated-edge suitable for controllably tearing the cover-sheet 170 in either direction after being roll-applied. The adhesive 172 comprising the linear strip is centrally-located along the cover-sheet 170 such that it is evenly placed for use (as a guide for installation). In this way the toilet-user will not accidentally contact the toilet because the cover-sheet 170 has been unequally placed. The adhesive 172 once deformed is activated as applied to the toilet seat upper surface rather than being adhesively coupled to itself while on the roll 102. Those with ordinary skill in the art will now appreciate that upon reading this specification and by their understanding the art of adhesives and coupling as described herein, methods of providing the correct amount of needed 'stickiness/adhesion' and the capability to promote adhesion after the deformation occurs will be understood by those knowledgeable in such art. FIG. 4 is a perspective view of the roller cover toilet system 100 of FIG. 1, according to an embodiment of the present disclosure.

Figure 5:
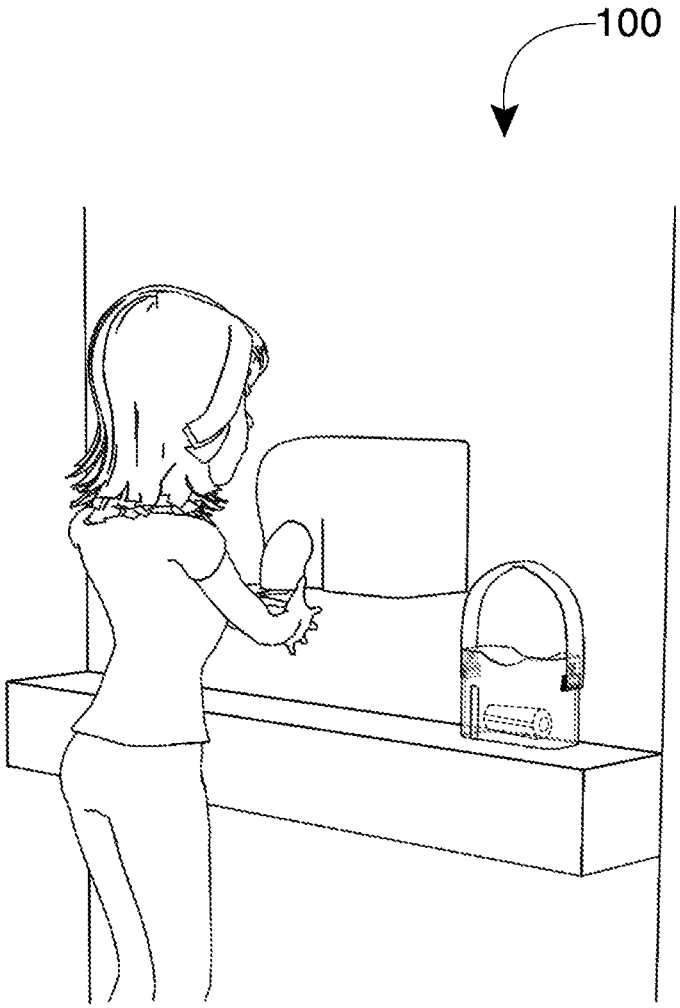
FIG. 5 is a perspective view of the roller cover toilet system of FIG. 1, according to an embodiment of the present disclosure.

FIG. 5 is a perspective view of the roller cover toilet system 100 of FIG. 1, according to an embodiment of the present disclosure. According to one embodiment, the roller cover toilet system 100 may be arranged as a kit. In particular, the roller cover toilet system 100 may further include a set of instructions with additional rolls 102. The instructions may detail functional relationships in relation to the structure of the roller cover toilet system 100 such that the roller cover toilet system 100 can be used, maintained, or the like, in a preferred manner.

The method for roller cover toilet system 100 may include one or more components or features of the roller cover toilet system 100 as described above. As illustrated, the method for using roller cover toilet system 100 may include the steps of: providing the roller cover toilet system; loading a roll of flexible cover-sheet in a roller receiver; and roll-applying the cover-sheet to a toilet seat upper surface to promote a sanitary seating surface for a toilet-user; wherein the step of roll-applying allows an adhesive to promote coupling between the cover-sheet and the toilet seat upper surface.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for use are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A roller cover toilet system, the system comprising:
a roller-dispenser assembly including
a roller-dispenser apparatus with a body defined by
a roller receiver with a cutting edge, the roller receiver interiorly comprising half of a cylinder;
a handle rigidly affixed exteriorly to the roller receiver;
a roller for sequentially roll-applying an interchangeable roll of continuous, flexible cover-sheet, the cover-sheet having two side edges, a top-side and a bottom-side, the cover-sheet having a leading edge for delivery, the bottom-side having an attachment means for removably attaching said cover-sheet, once dispensed and cut via said roller-dispenser apparatus, to a toilet seat upper surface to promote a sanitary seating surface for a toilet-user, the roller being rotatably mountable along a roller-axis interior to the roller receiver; and
an opening interrupting the roller-receiver having a rectangular edge, the opening being as wide as a diameter of the cylinder, the opening being parallel to the roller-axis, such that the cover-sheet may be dispensed by drawing the cover-sheet outwardly through the opening.

2. The roller cover toilet system of claim 1, wherein said cutting edge comprises at least one serrated-edge.

3. The roller cover toilet system of claim 2, wherein the cover-sheet comprises paper.

4. The roller cover toilet system of claim 2, wherein the cover-sheet comprises non-paper.

5. The roller cover toilet system of claim 2, wherein the attachment means comprises adhesive.

6. The roller cover toilet system of claim 5, wherein the adhesive is a linear strip.

7. The roller cover toilet system of claim 6, wherein the cover-sheet is flushable.

8. The roller cover toilet system of claim 7, wherein the adhesive is deformable.

9. The roller cover toilet system of claim 1, wherein the body comprises plastic.

10. The roller cover toilet system of claim 1, wherein the roller receiver comprises a cylindrical profile to form an accessible inner-volume.

11. The roller cover toilet system of claim 1, wherein the roller-dispenser assembly is removably mountable.

12. The roller cover toilet system of claim 2, wherein said cutting edge comprises a first-serrated-edge and a second-serrated-edge.

13. The roller cover toilet system of claim 6, wherein the adhesive comprising the linear strip is centrally-located along said cover-sheet.

14. The roller cover toilet system of claim 1, wherein the adhesive once deformed is activated as applied to said toilet seat upper surface.

15. The roller cover toilet system of claim 1, wherein the handle is perpendicular to said roller receiver.

16. The roller cover toilet system of claim 1, wherein the roller comprises a cylindrical-member.

17. A roller cover toilet system, the system comprising:
a roller-dispenser assembly including
a roller-dispenser apparatus with a body defined by
a roller receiver with a cutting edge, the roller receiver interiorly comprising half of a cylinder;
a handle rigidly affixed exteriorly to the roller receiver;
a roller for sequentially roll-applying an interchangeable roll of continuous, flexible cover-sheet, the cover-sheet having two side edges, a top-side and a bottom-side, the cover-sheet having a leading edge for delivery, the bottom-side having an attachment means for removably attaching said cover-sheet, once dispensed and cut via said roller-dispenser apparatus, to a toilet seat upper surface to promote a sanitary seating surface for a toilet-user, the roller being rotatably mountable along a roller-axis interior to the roller receiver; and
an opening interrupting the roller-receiver having a rectangular edge, the opening being as wide as a diameter of the cylinder, the opening being parallel to the roller-axis, such that the cover-sheet may be dispensed by drawing the cover-sheet outwardly through the opening;
wherein the attachment means comprises adhesive;
wherein the adhesive is a linear strip;
wherein the adhesive is deformable;
wherein the adhesive comprising the linear strip is centrally-located along said cover-sheet;
wherein the cover-sheet is flushable;
wherein the body comprises plastic;
wherein said cutting edge comprises a first-serrated-edge and a second-serrated-edge;
wherein the roller receiver comprises a semi-cylindrical profile to form an accessible arcuate inner-volume;
wherein the handle is substantially perpendicular to said roller receiver such that a pressure is able to be applied to facilitate an efficient rolling motion for application; and
wherein the roller-dispenser assembly is removably mountable.

18. The roller cover toilet system of claim 12,
wherein the roller cover toilet system is arranged as a kit
wherein the first-serrated-edge and the second-serrated-edge are separated by one-hundred and eighty degrees as measured about the roller receiver, with the roller being disposed between the first-serrated-edge and the second-serrated-edge, such that when dispensed from the roller-dispenser, the cover-sheet may be pulled against and cut by the first-serrated edge and alternatively the second-serrated edge.

19. A method of use for the roller cover toilet system, the method comprising the steps of:
providing the roller cover toilet system of claim 17;

loading a roll of flexible cover-sheet in a roller receiver; and roll-applying said cover-sheet to a toilet seat upper surface to promote a sanitary seating surface for a toilet-user.

20. The method of claim 19, wherein the step of roll-applying allows an adhesive to promote coupling between said cover-sheet and said toilet seat upper surface.

* * * * *